United States Patent [19]

Steklenski

[11] 4,431,727

[45] Feb. 14, 1984

[54] PROTECTIVE OVERCOATS FOR PHOTOGRAPHIC ELEMENTS

[75] Inventor: David J. Steklenski, Rochester, N.Y.

[73] Assignee: Eastman Kodak Company, Rochester, N.Y.

[21] Appl. No.: 388,322

[22] Filed: Jun. 14, 1982

[51] Int. Cl.[3] ..... G03C 1/78

[52] U.S. Cl. ..... 430/528; 430/527; 430/531; 430/536; 430/961; 430/271

[58] Field of Search ..... 430/531, 536, 271, 961, 430/527, 528

[56] References Cited

U.S. PATENT DOCUMENTS

| | | | |
|---|---|---|---|
| 2,169,004 | 8/1939 | Nadeau | 430/531 |
| 2,196,775 | 4/1940 | McNally | 430/536 |
| 2,362,580 | 11/1944 | Nadeau et al. | 430/536 |
| 3,640,708 | 2/1972 | Humphriss et al. . | |
| 4,025,338 | 5/1977 | Miyatuka et al. . | |
| 4,059,768 | 11/1977 | Van Landeghem et al. . | |
| 4,070,189 | 1/1978 | Kelley et al. . | |
| 4,214,035 | 7/1980 | Heberger | 430/531 |
| 4,237,194 | 12/1980 | Upson et al. . | |

*Primary Examiner*—Jack P. Brammer

*Attorney, Agent, or Firm*—J. Lanny Tucker

[57] ABSTRACT

Protective layers for photographic elements comprise a compatible blend of:

(a) cellulose nitrate and (b) a hydrophobic polymer wherein the blend has a sufficient amount of the hydrophobic polymer so as to have a glass transition temperature of at least about 50° C. and a sufficient amount of cellulose nitrate so as to be resistant to chlorinated hydrocarbon solvents and photographic processing compositions. The overcoat is particularly useful with motion-picture elements containing silver halide which are subjected to chlorinated hydrocarbon solvents during a cleaning process or during wet gate printing.

7 Claims, No Drawings

PROTECTIVE OVERCOATS FOR PHOTOGRAPHIC ELEMENTS

FIELD OF THE INVENTION

The present invention relates to new protective coatings for silver halide containing photographic elements.

CROSS-REFERENCE TO RELATED APPLICATION

This application is related to commonly assigned U.S. Ser. No. 388,321, by Steklenski, filed of even date herewith entitled Polymer Compositions Having a Low Coefficient of Friction.

DESCRIPTION RELATIVE TO THE PRIOR ART

Protective coatings for photographic elements containing silver halide layers are well known. Protective coatings have been formulated for both the emulsion side, that is, the side of the element which carries the layer containing the silver halide in a hydrophilic binder, and the other side of the element, commonly referred to in the art as the support side or the base side. These coatings are designed to provide a variety of properties such as resistance to abrasion and resistance to static charging.

Protective coatings for the base side of silver halide photographic elements have unique requirements. For example, in addition to providing abrasion and static-charging resistance, these coatings must also be resistant to ferrotyping. Ferrotyping refers to the polishing of the emulsion surface, frequently in a random pattern. Ferrotyping is frequently the result of contact between the coating on the base of an element with the emulsion on the other side of an element such as when the element is rolled upon itself or when separate elements are stacked base-to-emulsion. It is known that base side coatings with low glass transition temperatures or coatings which are hydrophilic frequently cause severe ferrotyping problems.

Certain photographic elements have further requirements which must be met by the base side protective overcoat. For example, the base side of the photographic element is often coated with an antistatic layer. This antistatic layer is generally composed of a binder having dispersed therein a conductive compound. The protective coating is applied over the antistatic layer. Frequently, chemicals in a photographic processing solution or in the environment are capable of reacting with the conductive compound in the antistatic layer, thus causing the antistatic layer to lose much of its conductivity. Thus, a protective layer for an element having a base side antistatic layer must be capable of chemically isolating the antistatic layer.

Certain types of photographic elements have certain further requirements. Elements which are used in motion pictures are cleaned using chlorinated hydrocarbon solvents. In addition, the elements are duplicated in what is known in the art as a "wet gate" printer. In a wet gate printer, the printing gate is constructed so that the photographic element to be duplicated is immersed in a chlorinated hydrocarbon solvent during the duplicating exposure. A useful base side protective coating for this type of element must be resistant to chlorinated hydrocarbon solvents.

Many base side overcoat compositions are deficient in one or more respects. One class of conventional overcoats is the acrylate polymers. These polymers provide excellent abrasion resistance, charging characteristics, ferrotyping resistance and other desirable properties. Unfortunately, however, they are readily removed or softened by chlorinated hydrocarbon solvents. Acrylate polymer protective overcoats are described in relation to the polyaniline salt-containing antistatic layers of U.S. Pat. No. 4,237,194. Cellulose esters such as cellulose acetate or cellulose acetate butyrate are potential overcoat candidates because they are solvent-resistant. However, these polymers are easily penetrated by alkaline photographic processing compositions and are thus not capable of chemically isolating the antistatic layer. Cellulose nitrate is resistant to both solvents and processing compositions; however, a layer of cellulose nitrate has poor charging characteristics and a low glass transition temperature. Further, cellulose nitrate alone is dangerous to coat because it is highly flammable.

It is readily apparent that there is a continuing need for overcoats for the base side of photographic elements. The need is particularly acute for elements which contain a layer, such as an antistatic layer, which must be chemically isolated and which must be protected from chlorinated hydrocarbon solvents.

SUMMARY OF THE INVENTION

A blend of cellulose nitrate and a hydrophobic polymer provides a desirable overcoat for the base side of photographic elements. In preferred embodiments, only a small amount of cellulose nitrate is required to impart chlorinated organic solvent resistance and photographic processing composition resistance to the blend. Further, even at comparatively high concentrations of cellulose nitrate, the blend has a glass transition temperature which is high enough so that ferrotyping is substantially eliminated.

In one aspect of the present invention, there is provided a radiation-sensitive photographic element comprising a support having on one side thereof a hydrophilic, radiation-sensitive layer and on the other side thereof, as the outermost layer, a layer comprising a compatible blend of:

(a) cellulose nitrate and (b) a hydrophobic polymer, wherein the blend has a glass transition temperature of at least about 50° C. and contains a sufficient amount of cellulose nitrate so as to be resistant to chlorinated hydrocarbon solvents and photographic processing compositions.

As noted, the protective overcoats of the present invention are particularly useful with elements which contain an antistatic layer on the base side of the support. Thus, in another aspect of the present invention there is provied a photographic element wherein the side opposite the radiation-sensitive layer has thereon, in order, an antistatic layer comprising a binder having therein a conductive compound and, as the outermost layer, a layer comprising the described compatible blend.

The protective overcoat layers of the present invention provide all of the desired physical properties. The layers are relatively resistant to abrasion, resistant to static charging, resistant to ferrotyping, capable of chemically isolating an antistatic layer and are resistant to chlorinated hydrocarbon solvents.

DETAILED DESCRIPTION OF THE INVENTION

The protective layers of the present invention comprise compatible blends of cellulose nitrate and a hydrophobic polymer. By "compatible" is meant that a layer cast from a homogeneous solution of the blend exhibits substantially no phase separation and is substantially clear. Cellulose nitrate is capable of forming a compatible blend with a wide variety of hydrophobic polymers. Whether a particular blend is compatible is determined by simple experiment. The polymer blend in question is dissolved in a solvent or solvent mixture and cast on a glass slide. A solvent mixture of acetone and 2-methoxyethanol (95/5 by volume) is useful. The acetone is a true solvent for cellulose nitrate and the 2-methoxyethanol is present to reduce the drying rate. The cast layer is allowed to dry and is visually observed. The blend is considered compatible if little or no light scattering is detected visually by viewing the layer at low angles of light incidence. This is an art-recognized method for determining polymer blend compatibility. (See R. J. Peterson et al, "Recent Advances in Polymer Compatibility", *ACS Polymer Preprints, pages* 385–391, 1969.)

Cellulose nitrate is the reaction product of cellulose with nitric acid. Cellulose is composed of a large number of $\beta$-anhydroglucose units. The glucose units have three hydroxyl groups and are joined together by acetyl linkages. Various grades of cellulose nitrate are characterized by the degree of substitution by nitro groups of the hydroxyl groups in the anhydroglucose units and by the degree of polymerization. Cellulose nitrates which are useful in the present invention include any of a wide variety of cellulose nitrates including those which are commercially available. Useful cellulose nitrates include RS® cellulose nitrates, as well as AS® and SS® cellulose nitrates. RS® cellulose nitrate, for example, has a nominal degree of substitution which corresponds to a nitrogen content of about 12 percent. The viscosity of a particular cellulose nitrate is related to its degree of polymerization and is expressed in terms of either centipoise or the time, expressed in seconds for a metal ball of specified size and density to fall through a measured distance in a solution of the cellulose nitrate. For the purposes of the present specification, the viscosity in seconds is the time required for a 1/32-inch (0.08 cm) steel ball to fall 2 inches (5.08 cm) in a 12.2 percent solution of the cellulose nitrate in acetone at 25° C. This corresponds to the ASTMD1343-56 procedure. Reference is made to H. M. Sperlin et al, "Cellulose and Cellulose Derivatives", *High Polymers,* Vol. V, 2nd edition, part 3, Interscience, New York, 1955.

The other component of the compatible polymer blend of the layers of the present invention is a hydrophobic polymer. By "hydrophobic" is meant substantially water-insoluble and substantially not swellable in water. In preferred embodiments, the polymer is an acrylate polymer, i.e., either a homopolymer of an acrylate monomer or a copolymer which comprises at least about 10 weight percent of an acrylate monomer. The acrylate polymer or other hydrophobic polymer has a glass transition temperature such that, when it is mixed with the desired amount of the cellulose nitrate, it provides a layer having a glass transition temperature of at least about 50° C. Acrylate monomers are esters of ethylenically unsaturated mono or dicarboxylic acids. Useful monomers include methyl methacrylate, ethyl acrylate and diethyl ethylenemalonate. The comonomer of the acrylate copolymers which are useful in the blends of the present invention are any of a wide variety of monomers. Useful monomers include copolymerizable, $\alpha\beta$-ethylenically unsaturated monomers. Useful monomers of this type include ethylene, propylene, 1-butene, isobutene, 2-methylpentene, 1,1,4,4-tetramethylbutadiene, styrene and $\alpha$-methylstyrene; and monoethylenically unsaturated esters of aliphatic acids such as vinyl acetate, isopropenyl acetate and allyl acetate.

Useful hydrophobic acrylate polymers include poly(methyl methacrylate), poly(butyl acrylate-co-methyl methacrylate), poly(vinyl acetate-co-methyl methacrylate), poly(ethyl methacrylate) and poly(styrene-co-methyl methacrylate). Other nonacrylate polymers which are useful in the blend include poly(vinyl acetate) and cellulose acetate butyrate.

The protective overcoat layers of the present invention are coated from a solvent solution of the polymers. The solvent chosen is capable of dissolving both components of the blend. Frequently, it is desirable to use a solvent mixture in order to adjust the viscosity of the coating composition, to economize on solvent cost or for some other purpose. Cellulose nitrate is soluble in a variety of solvents including ketones, esters, amides and nitroparaffins. Certain alcohols are also solvents for nitrocellulose, particularly when used in admixture with other solvents. Useful alcohol solvents include isopropanol and 2-methoxyethanol. If a solvent mixture is used, the cosolvent is any of a wide variety of solvents. Useful cosolvents include acetone, ethyl acetate and methyl ethyl ketone. Useful diluents include liquid hydrocarbons, either aromatic or aliphatic, such as benzene, xylene, 1,1,1-trichloroethane, 1,2-dichloromethane and toluene.

The described polymer blends are coated to produce the protective layers of the present invention using any suitable method. For example, the compositions are coated by spray coating, fluidized bed coating, dip coating, doctor-blade coating or extrusion hopper coating.

The weight percent solids in the coating composition which is useful to form the layers of the present invention varies widely. The percent solids, along with the method of coating, substantially influences the coverage of the layer which result from coating the composition. A useful range for the weight percent solids in the coating composition depends on the specific members of the polymer blend and the solvents chosen and is generally between about 1 percent to about 10 percent.

The layers containing the polymer blends of the present invention have a glass transition temperature which is at least about 50° C. Measurement of the glass transition temperature is made by methods which are well-known in the art. (See, for example, *Techniques and Methods of Polymer Evaluation,* Vol 1, Marcel Dekker, Inc, NY, NY.)

The polymer blend contains sufficient cellulose nitrate so as to provide resistance to chlorinated hydrocarbon solvents and photographic processing compositions. By "resistance to chlorinated hydrocarbon solvents" is meant that the coated and dried layer is substantially unaffected when contacted with the described solvent. The determination of whether a particular blend will be resistant to chlorinated hydrocarbon solvents is carried out by the following simple test. The blend of interest is coated on a suitable support such as a glass slide or a cellulose acetate support and allowed to dry. A sample of the element is then passed through an ultrasonically agitated bath of 1,1,1-trichloroethane at 40° C. such that its residence time in the bath is about 15 seconds. The coating is then visually examined for the effect of this treatment. If the layer remains intact during this treatment, it is considered to be resistant to chlorinated hydrocarbon solvents. Generally the same amount of cellulose nitrate also provides resistance to photographic processing compositions. That is, the layer is capable of chemically isolating underlayers from high pH solutions. One method of determing whether a layer such as an antistatic layer is chemically isolated is to measure the electrical resistance before and after contact with the solution. If there is no change, the layer is sufficiently isolated. It is desirable to maintain the amount of cellulose nitrate at the lowest level possible consistent with maintaining solvent and processing composition resistance because cellulose nitrate is extremely flammable. The preferred amount of cellulose nitrate in the blend is between 5 and 70 percent by weight.

As noted previously, the protective overcoat layers of the present invention are particularly useful over antistatic layers on the base side of a silver halide photographic element. Useful antistatic layers include those described in U.S. Pat. Nos. 3,399,995, 3,674,711 and 3,011,918 which relate to layers containing water-dispersible, particulate polymers. One particularly preferred antistatic layer is described in U.S. Pat. No. 4,070,189 which relates to the use of water-dispersible, particulate vinylbenzyl quaternary ammonium or phosphonium salt polymers. Another useful antistatic layer of this type is described in U.S. Pat. No. 4,294,739. Another class of particularly preferred antistatic layers consists of the polyaniline salt-containing layers described, for example, in U.S. Pat. Nos. 3,963,498 and 4,237,194.

As noted, a particularly preferred antistatic composition is described in U.S. Pat. No. 4,070,189. Unlike many antistatic layers, the layers of this patent include hydrophobic binders. The overcoat layers of the present invention are preferably used with the antistatic layers of U.S. Pat. No. 4,070,189 because of the excellent adhesion of the layers to each other. The antistatic layers of this patent comprise an antistatic, highly crosslinked vinylbenzyl quaternary ammonium polymer in combination with a hydrophobic binder wherein the weight ratio of binder to antistatic crosslinked polymer is about 10:1 to 1:1. The antistatic highly crosslinked vinylbenzyl ammonium polymer includes polymers represented by the formula:

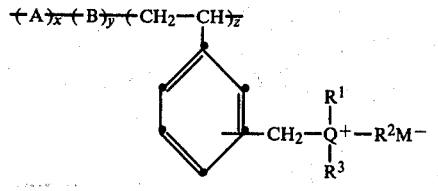

wherein:

A is a polymerized monomer containing at least two ethylenically unsaturated groups;

B is a polymerized copolymerizable, $\alpha,\beta$-ethylenically unsaturated monomer;

Q is N or P;

$R^1$, $R^2$ and $R^3$ are independently selected from the group consisting of carbocyclic, alkyl, aryl and aralkyl, and $R^1$, $R^2$ and $R^3$ together optionally form the atoms necessary to complete a heterocyclic ring with Q, such as pyridinium;

$M^-$ is an anion;

x is from about 0.1 to about 20 mole percent;

y is from about 0 to about 90 mole percent; and z is from about 10 to about 90 mole percent.

the hydrophobic binder of the compositions described in U.S. Pat. No. 4,070,189 include cationic or neutral hydrophobic film-forming polymers such as acetylated cellulose, poly(methyl methacrylate), poly(ethyl acrylate), poly(styrene), poly(butyl methacrylate-co-styrene) (60:40), poly(vinyl acetal) and cellulose acetate butyrate.

A second preferred class of antistatic layer compositions includes a polyaniline salt semiconductor. Compositions of this type are described, for example, in U.S. Pat. Nos. 3,963,498 and 4,237,194. The compositions of U.S. Pat. No. 4,237,194 are particularly preferred because they exhibit high conductivity at low coverages of the semiconductor. The antistatic layer of this patent comprises a coalesced, cationically stabilized latex and a polyaniline acid addition salt semiconductor wherein the latex and the semiconductor are chosen so that the semiconductor is associated with the latex before coalescing. Particularly preferred latex binders include cationically stabilized, coalesced, substantially linear, polyurethanes.

In addition to the polymer blend as described, the protective layer of the present invention optionally contains other components. Useful components include plasticizers, waxes, matting agents, charge-control agents and dyes.

In a preferred embodiment, the conducting or antistatic layer contains the previously described polyaniline acid addition salt. Since these salts usually are slightly green in color, it is desirable to include a small amount of a complimentary colored dye in the overcoat or conducting layer so as to produce a visually neutral element. Useful dyes include roseaniline chloride and Neutral Red (CI 50040).

In the currently preferred embodiment of the present invention, the polymer blend comprises a minor amount of a crosslinked silicone polycarbinol as described in commonly assigned U.S. Ser. No. 388,321, by Steklenski, filed of even date herewith entitled Polymer Compositions Having a Low Coefficient of Friction.

Photographic elements comprise a support having thereon at least one radiation-sensitive layer. The protective layer of the present invention is coated as the outermost layer on the base side of the photographic element. The other side of the photographic element, commonly referred to as the emulsion side, has as its outermost layer a hydrophilic layer. This hydrophilic layer is either the radiation-sensitive layer itself such as one containing silver halide or an overcoat layer which is hydrophilic so as to facilitate processing of the element. This outermost hydrophilic layer optionally contains a variety of addenda such as matting agents, antifoggants, plasticizers and haze-reducing agents. The outermost hydrophilic layer comprises any of a large number of water-permeable hydrophilic polymers. Typical hydrophilic polymers include gelatin, albumin, poly(vinyl alcohols) and hydrolyzed cellulose esters.

The photographic silver halide radiation-sensitive layers are well-known in the art. Such layers are more completely described in *Research Disclosure*, December, 1978, pages 22–31, item 17643. *Research Disclosure* is published by Industrial Opportunities, Ltd, Homewell, Havant, Hampshire, PO9 1EF, United Kingdom.

The photographic elements of the present invention include a photographic support. Useful supports include those described in paragraph XVII of the above-identified *Research Disclosure.* Particularly useful supports include cellulose acetate and poly(ethylene terephthalate).

The following examples are presented to illustrate the practice of the present invention.

EXAMPLE 1-5

A. Preparation of Coating Solutions and Coated Films

Coating solutions were prepared by dissolving poly(methyl methacrylate) [Elvacite 2010®, E I duPont] and cellulose nitrate [RS®, ½ second grade, Hercules, Inc] in amounts shown below into a 90/10 (volume) mixture of acetone and isopropanol. The resulting clear solutions were then coated onto unsubbed cellulose acetate support to give clear, continuous coated layers on the support. All layers had glass transition temperatures in excess of 50° C.

B. Effect of 1,1,1-Trichloroethane Film Cleaning

Samples of the films prepared above were passed through a simulated film cleaner consisting of an ultrasonically agitated bath of 1,1,1-trichloroethane at 40° C. The films, which were originally clear and hard, were evaluated for changes in clarity and hardness. This is a subjective evaluation by an experienced observer.

C. Effect of Wet-Gate Printing Using Tetrachloroethylene

Samples of the films prepared in section A were soaked in tetrachloroethylene for 30 sec at 21° C. and evaluated as in section B. Table 1 lists the post-treatment hardness in this test under "Wet-Gate Hardness". This is also a subjective evaluation by an experienced observer.

TABLE 1

| Example | Elvacite ® 2010 | g Cellulose Nitrate | Post Treatment Clarity | Post-Treatment Hardness | Wet Gate Hardness |
|---|---|---|---|---|---|
| Comparison | 3.0 | 0.0 | Moderate haze | Greatly softened | Moderately softened |
| 1 | 2.85 (95% by wt.) | 0.15 | Very slight haze | Slightly softened | Slightly softened |
| 2 | 2.7 (90% by wt.) | 0.3 | Clear | Unchanged | Unchanged |
| 3 | 2.4 (80% by wt.) | 0.6 | Clear | Unchanged | Unchanged |
| 4 | 1.8 (60% by wt.) | 1.2 | Clear | Unchanged | Unchanged |
| 5 | 1.5 (50% by wt.) | 1.5 | Clear | Unchanged | Unchanged |

EXAMPLE 6

Coating solutions and films were prepared as in Example 1, but using mixtures of poly(butylacrylate-co-methyl methacrylate) [20/80] and RS® 5-6 second-grade cellulose nitrate. Samples of the resulting films were passed through the simulated film cleaner with the following results:

| Film No | Wt % Cellulose Nitrate | Post-Treatment Clarity | Post-Treatment Hardness |
|---|---|---|---|
| Comparison | 0 | film dissolved | — |
| Example 7 | 50 | clear | unchanged |

EXAMPLES 7-9

Cellulose nitrate-poly(methyl methacrylate) layers as described in Example 1 were coated as protective overcoats over conductive compositions described in U.S. Pat. Nos. 4,025,463, 3,963,498 and 4,237,194. The overcoat layers provided protection for the sensitive conductive layers from the effects of photographic processing solutions. This was evidenced by the fact that no change in conductivity was observed as a result of control with processing solutions. The overcoats also demonstrated the same resistance to chlorinated solvents as detailed in Example 1.

EXAMPLES 10-15

Coatings of polymer blends and individual polymers for comparison were made over the conducting layer similar to the layer described in Example 1 of U.S. Pat. No. 4,237,194 which had been applied to cellulose acetate support. The polymers and polymer blends were tested in two ways. Resistance to photographic developer was tested by immersing the film strip into a black-and-white photographic developer having a pH of about 11.0 for 10 minutes. Measurement of coating resistivity before and after treatment is indicative of the resistance of the protective layer to processing solutions. The second test is a simulated film cleaner in which the film is passed through an ultrasonically agitated bath of 1,1,1-trichloroethane at 40° C. as in Example 1. The film is examined for the effect of this simulated cleaning. Results of coatings of the polymers and polymer/cellulose nitrate blends are given in Table 2. All coatings were made from 3% (wt/vol) solutions in 95/5 acetone/2-methoxyethanol (by volume).

TABLE 2

| Example | Overcoat Layer | Resistance to Developer | Effect of Film Cleaning |
|---|---|---|---|
| Comparison B | Poly(vinyl acetate) - AYAT ® Union Carbide Corp. | Poor | Overcoat layer removed. |
| 10 | 50/50 wt AYAT/5-6 sec. cellulose nitrate | Good | No apparent effect. |
| Compariosn C | Poly(vinyl acetate-co-methyl methacrylate) 70:30 (PVA-MMA) | Poor | Overcoat layer removed. |
| 11 | 50/50 wt PVA-MMA/5-6 sec. cellulose nitrate | Good | No apparent effect. |
| Comparison D | Poly(n-butyl methacrylate-co-methyl methacrylate) Elvacite ® | Fair | Haze - overcoat layer partially |

TABLE 2-continued

| Example | Overcoat Layer | Resistance to Developer | Effect of Film Cleaning |
|---|---|---|---|
| | 2013 - E. I. duPont | | removed. |
| 12 | 50/50 wt Elvacite ® 2013/5-6 sec. cellulose nitrate | Good | No apparent effect. |
| Comparison E | Poly(ethyl methacrylate) Elvacite ® 2042 - E. I. duPont | Good | Overcoat layer removed. |
| 13 | 50/50 wt Elvacite ® 2042/5-6 sec. cellulose nitrate | Good | No apparent effect. |
| Comparison F | Cellulose acetate butyrate CAB ® 381-20 - Eastman Kodak Co. | Good | Overcoat layer softened and floated off support. |
| 14 | 50/50 wt CAB ® 381-20/5-6 sec. cellulose nitrate | Good | No apparent effect. |
| Comparison G | Styrene/acrylate copolymer Stymer ® LF-25 - Monsanto | Poor | Overcoat layer removed. |
| 15 | 50/50 wt Stymer ® LF-25/5-6 sec. cellulose nitrate | Good | No apparent effect. |

Although the invention has been described in considerable detail with particular reference to certain preferred embodiments thereof, variations and modifications can be effected within the spirit and scope of the invention.

What is claimed is:

1. A radiation-sensitive photographic element comprising a support having on one side thereof a hydrophilic, radiation-sensitive layer and on the other side thereof, as the outermost layer, a layer comprising a compatible blend of:

(a) cellulose nitrate and (b) a hydrophobic polymer wherein said blend has a glass transition temperature of at least about 50° C. and contains a sufficient amount of cellulose nitrate so as to be resistant to chlorinated hydrocarbon solvents.

2. A photographic element comprising a support having on one side thereof a hydrophilic, radiation-sensitive silver halide layer and on the other side thereof, an antistatic layer comprising a binder having therein a conductive compound and, as the outermost layer, a layer comprising a compatible blend of:

(a) cellulose nitrate and (b) a hydrophobic polymer wherein said blend has a glass transition temperature of at least about 50° C. and contains a sufficient amount of cellulose nitrate so as to be resistant to chlorinated hydrocarbon solvents.

3. A silver halide photographic element as in claim 2 wherein said antistatic layer comprises an antistatic, crosslinked vinylbenzyl quaternary ammonium polymer in combination with a hydrophobic binder, wherein the weight ratio of binder to antistatic crosslinked polymer is about 10:1 to 1:1.

4. A photographic element as in claim 2 wherein said antistatic layer comprises a coalesced, cationically stabilized latex and a polyaniline acid addition salt semiconductor, wherein the semiconductor is associated with the latex before coalescing.

5. A photographic element as in claims 1 or 2 wherein said blend contains between 5 and 70 percent by weight cellulose nitrate.

6. A element as in claims 1 or 2 wherein said hydrophobic polymer is a polymer which comprises at least about 10 weight percent of an acrylate.

7. A photographic element as in claims 1 or 2 wherein said hydrophobic polymer is selected from the group consisting of poly(methyl methacrylate), poly(butyl acrylate-co-methyl methacrylate), poly(vinyl acetate-co-methyl methacrylate), poly(ethyl methacrylate) and poly(styrene-co-methyl methacrylate).

* * * * *